US007841597B2

(12) United States Patent
Cammegh

(10) Patent No.: US 7,841,597 B2
(45) Date of Patent: Nov. 30, 2010

(54) AUTOMATIC ROULETTE WHEEL

(75) Inventor: Richard William Cammegh, Kent (GB)

(73) Assignee: Cammegh Limited (GB)

( * ) Notice: Subject to any disclaimer, the term of this patent is extended or adjusted under 35 U.S.C. 154(b) by 1268 days.

(21) Appl. No.: 10/553,498

(22) PCT Filed: Apr. 16, 2004

(86) PCT No.: PCT/GB2004/001644

§ 371 (c)(1),
(2), (4) Date: Apr. 11, 2006

(87) PCT Pub. No.: WO2004/094013

PCT Pub. Date: Nov. 4, 2004

(65) Prior Publication Data

US 2006/0267274 A1 Nov. 30, 2006

(30) Foreign Application Priority Data

Apr. 16, 2003 (GB) ..... 0308772.3

(51) Int. Cl.
*A63F 5/00* (2006.01)

(52) U.S. Cl. ..... 273/142 R

(58) Field of Classification Search ..... 273/142 R, 273/309

See application file for complete search history.

(56) References Cited

U.S. PATENT DOCUMENTS 3,853,324 A 12/1974 Reiner et al.
4,337,945 A 7/1982 Levy
4,601,470 A 7/1986 Kadota et al.
4,643,425 A * 2/1987 Herzenberger ..... 463/17
4,732,385 A * 3/1988 Castellanos ..... 273/142 B
4,735,416 A 4/1988 McNally
4,869,505 A * 9/1989 Manabe ..... 463/22
4,989,873 A * 2/1991 Manabe ..... 463/22
5,588,650 A * 12/1996 Eman et al. ..... 273/142 B
5,755,440 A * 5/1998 Sher ..... 273/142 E
5,775,993 A * 7/1998 Fentz et al. ..... 463/17
5,827,119 A 10/1998 Bromley
5,836,583 A * 11/1998 Towers ..... 273/142 B
6,047,965 A * 4/2000 Mollo et al. ..... 273/142 E
6,083,105 A 7/2000 Galanter (Continued)

FOREIGN PATENT DOCUMENTS

WO WO 01/32278 A1 5/2001

(Continued)

OTHER PUBLICATIONS

"The Cammegh Slingshot", published prior to Jun. 24, 2003.

*Primary Examiner*—Gene Kim
*Assistant Examiner*—Amir Klayman
(74) *Attorney, Agent, or Firm*—Barnes & Thornburg LLP

(57) ABSTRACT

An automatic roulette wheel 40 in which, at the end of a turn, the ball (a) is ejected from the pocket 13 by a jet of air and moves to the top of the ball track 14. The ball is held against the edge of the ball track and propelled around the ball track by air jets and, after a predetermined time, the air jets are turned off and the ball spirals down the slope into a pocket on the contra-rotating wheel. The process can then be repeated with the directions reversed, kept the same or randomly varied.

25 Claims, 7 Drawing Sheets

U.S. PATENT DOCUMENTS

| | | | | |
|---|---|---|---|---|
| 6,164,647 | A * | 12/2000 | Chee | 273/142 R |
| 6,520,854 | B1 | 2/2003 | McNally | |
| 7,311,305 | B2 * | 12/2007 | Matsuno et al. | 273/142 E |
| 2006/0055109 | A1 * | 3/2006 | Yokota et al. | 273/142 R |

FOREIGN PATENT DOCUMENTS

| | | |
|---|---|---|
| WO | WO 03/051476 A1 | 6/2003 |

* cited by examiner

AUTOMATIC ROULETTE WHEEL

The present invention relates to gaming wheels, more particularly it relates to roulette wheels in which the ball is automatically put in play.

Roulette is a well-known casino game which has been played for many years. A typical conventional roulette game includes a table bearing, a felt covering upon which indicia forming a betting layout has been silk-screened or otherwise imprinted. A typical roulette wheel includes a number ring with a circular array of numbered segments bearing numbers 1 through 36. In addition, the number ring typically includes the numbers 0 and 00 disposed at diametrically opposite locations on the number ring. The numbers 1 through 36 are not disposed in numerical order, but are typically disposed in a predetermined arrangement, such that roulette wheels located in different casinos will have the same standard predetermined number ring arrangement. The numbers disposed in a circular array in the number ring region of the wheel bear the alternating colours of red and black, with the exception of the 0 and 00 numbers, which are typically coloured green. A ring of pockets corresponding in number to the plurality of numbers of the circular number ring lies adjacent, but radially inward of the number ring, on the typical roulette wheel. In addition, a typical roulette wheel includes a circular, inclined ball track, disposed above, and radially outwardly of the number ring.

In operation of a typical roulette game, players place chips or tokens on the betting layout located on the roulette table, and then the croupier or dealer spins the roulette wheel to place the ball in motion about the circular ball track. As the wheel slows, the ball moves radially inwardly and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

In order to reduce costs, automatic roulette wheels have been devised in which the process of putting the ball in play is done automatically. These machines can be made like slot machines with the bets being placed and winnings paid out using a machine rather than a croupier. This reduces the costs associated with security, chips, dealers, etc.

In a known system, in order to recover the ball after each spin, a trap door opens beneath the pockets and the ball drops through this trap door and passes through a series of channels and is returned back up to its starting position. The ball can then be put in play by a solenoid firing the ball onto the ball track.

Another system is disclosed in U.S. Pat. No. 4,735,416 in which the wheel is displaced relative to a rim and the ball falls into the gap formed and into a return channel under the wheel for returning to its start position. Such systems involve the ball disappearing from view and involves complicated machinery to recover the ball and fire it into play. Such complication requires a great deal of maintenance and servicing, particularly to maintain the accuracy of the wheel and the randomness of the winning numbers.

We have now devised an automatic roulette wheel which reduces these problems.

According to the invention there is provided a gaming apparatus which comprises (i) a stationary base; (ii) a wheel having a rotor rotatably mounted on a vertical axis with respect to the base, the rotor having pockets on its periphery into which a ball can be received with each pocket being associated with a number; (iii) a peripheral inclined surface concentric with the rotor for receiving a ball rollably thereon in which the ball will roll into one of the pockets when the ball slows, the said surface comprising a circular, inclined ball track, disposed above, and radially outwardly of the rotor and (iv) a means to propel the ball along the ball track, each pocket having a hole in it and there being at least one air injection means which is connectable to the said hole so that a ball received in a pocket can be ejected from the pocket onto the peripheral inclined surface by air coming out of the hole.

The apparatus is particularly suitable for use in playing roulette but can be used for any other game which is played on a roulette wheel or roulette type wheel and can include games in which more than one ball is in play during the game.

The roulette wheel or rotor is able to be rotated in both directions.

The means for propelling the ball along the said ball track are preferably air jets positioned at the edge of the ball track which can direct a jet of air at the ball thus impelling the ball along the ball track. The speed of the ball will cause centrifugal force to cause the ball to move to the outer edge of the ball track where preferably there is a rim to prevent the ball leaving the ball track.

In one embodiment the air injection means for ejecting the ball from the pocket comprises a nozzle connected to an air pump or other source of air at above atmospheric pressure which nozzle is aligned so that it is directly in line with the holes in the pockets as the wheel rotates. Preferably the gap between the nozzle and the hole is kept to a minimum. A ball detector means such as an optical sensing system of the type which is well known in the art or as referred to below, senses which pocket the ball has finished in and the wheel can be brought to a virtual standstill with that pocket aligned with a nozzle. After the ball is ejected from the pocket, the direction of rotation of the wheel can be reversed for the next go.

Alternatively the wheel can be rotated in the same direction each time or the rotation can be reversed randomly or any other arrangement for direction of spin can be used.

In order to ensure that the ball is ejected at the correct velocity each time, it is important that the hole in a pocket is accurately aligned with the nozzle. In practice this means that the rotor must be stopped so that the hole is accurately aligned. In order to achieve the required degree of accuracy a stepper motor can be used to rotate the rotor and there are control means so that the motor can be stopped between steps. There is preferably a computer control means in which the output from the ball detector or sensor or sensors which detect the pocket containing the ball is fed to the computer and the motor controlling the rotation of the rotor is also controlled by the computer and the computer controls the alignment to the required degree of accuracy.

The location of the nozzle and the position of the means to propel the ball along the said ball track are arranged so that, when the ball is ejected, it is automatically in the correct position to be propelled along the ball track.

An alternative arrangement is a conduit such as a pipe or tube leading from the nozzle to a hole in the pocket when the rotor is stopped. When the rotor is stationary and the pocket containing the ball is positioned correctly in relation to the means to propel the ball along the ball track, air is blown down the conduit to the hole and ejects the ball.

To ensure greater accuracy there is preferably a plate mounted below the rotor which is rotatable with the rotor, which plate has a plurality of apertures through it with each aperture corresponding to a pocket and there are conduits fixed to the upper surface of the plate, each conduit having one end connected to an aperture in the plate and the other end connected to the hole in a pocket so it provides an air passage from the plate to the pocket, the air injector is mounted below the plate and can be sequentially aligned with each aperture as the plate rotates so that, when an aperture in the plate is aligned with the air injector, air can be blown through the aperture in the plate, down the conduit to the pocket and so eject a ball from the pocket. The gap between the end of the air injector and the plate is accurately fixed so that the rotor and plate can rotate freely and there is adequate pressure of air to eject the ball. The conduits can be rigid or made of flexible tubes, piping etc. There are the same number of apertures as there are pockets and there is one conduit connecting an aperture to each pocket.

Preferably the plate and the rotor are mounted on the same shaft so, in use, the plate, conduits and rotor all rotate as one unit.

There is a sensor which senses which pocket contains the ball and the control system then brings the rotor to rest so that, when a ball is ejected and is propelled to the rim of the ball track, the ball is in the right position to be propelled along the ball track and the aperture in the plate connected to that pocket and the air injector are accurately aligned.

The control of the air in the air injector, and the jets propelling the ball round the rim can be conveniently controlled by valves operated by solenoids (solenoid valves) to facilitate the turning on and off of the jets.

There can be a computer control system which controls the rotation of the wheel and the timing of the air jet which ejects the ball from the pocket and turns on the air propelling the ball along the rim.

In use, at the end of a turn the ball is resting in a pocket and the rotor is rotating slowly or is stationary. As the rotor rotates a sensor senses the pocket with the ball in it and stops the rotor so the ball is correctly positioned in relation to the air jet(s) propelling the ball along the rim and a jet of air ejects the ball from the pocket; the ball runs up the ball track to the edge where it is propelled around the ball track by the jets of air; the ball can be kept continuously in motion for as long as desired by puffs of air from the jets of air. The rotor is brought up to speed in a direction opposite to the direction that the ball is moving around the ball track; the direction the ball is propelled around the ball track and the direction of rotation of the rotor can be reversed for each turn, or alternatively the directions can be the same for each turn or the rotation can be reversed randomly or any other arrangement for direction of spin can be used provided that the ball and rotor move in contra-rotating directions.

After a predetermined time the air jets are turned off and the ball then spirals down the ball track to the contra-rotating rotor thus simulating the action of a croupier. The duration of time that the ball is held up on the ball track can be varied or chosen at random in order to prevent prediction of where the ball will land by use of scanners etc. Other methods of preventing predictability can be implemented by randomly varying the speed of rotation of the rotor in use. These can be carried out after the "no more bets" signal.

Preferably there are a plurality of jets positioned around the periphery of the rim of the ball track so that the ball can be propelled along the rim for the required period of time, normally a few seconds, and then the jets can be turned off so that the ball will spiral down, simulating the action of the croupier. The air jets can operate by blowing puffs of air so that the ball can be kept propelled along the ball rim for a controllable period; this period can be fixed, determined by an operator or chosen at random etc.

Preferably there are air jets positioned to propel a ball in either direction, clockwise or counter clockwise, as a croupier can spin the wheel in either direction and the ball can then circulate around the ball track in the opposite direction to the direction the wheel is rotating.

Without the air jets or other means to propel the ball, the ball tends to bounce off the rim and is then thrown back against it in a manner which can be unsatisfactory and can give an unrealistic effect.

Preferably there is a transparent cover such as a glass or transparent plastic cover over the apparatus such as a transparent sheet which fits into the apparatus in the rim above the air jets. This has the effect of improving the action and control of the air jets. The central rotor is then mounted so that it fits beneath the sheet. Above the sheet is preferably a static turret. This turret preferably has a smooth reflective surface and can be, for example, in the shape of a cylinder or has a circular cross section of varying diameter along its length i.e. it has a curvilinear shape. In use, the numbers of the wheel are reflected in the turret and, as the wheel rotates, the turret has the appearance of movement.

Preferably there are a plurality of ball stops uniformly located around the peripheral inclined surface; in a typical wheel there can be eight ball stops and the means for ejecting the ball from the pocket is positioned so that the ball is ejected between the ball stops.

Preferably the operation of the wheel and the turning on and off of the air, etc. is computer controlled.

In addition, to incorporate further random effects the duration of the time the air jets are turned on and the time to reverse the direction of rotation of the wheel can be random so there is no predictability about the operation of the apparatus.

The motor is preferably a stepper motor which enables there to be accurate control of its operation and preferably the motor is coupled directly to the rotor e.g. by a friction drive with a step down gearing to give high torque drive to the rotor and wheel which improves control or by a belt drive etc.

Optionally the outermost section of the ball track adjacent to the rim is at an angle to the horizontal which is less than that of the rest of the ball track. This means that, in use, less centrifugal force is required to hold the ball against the rim than is required to propel the ball up to the rim. In use, when the ball reaches this outermost section, it will tend to stay against the rim as the ball track slows down or the air jets are turned off and when it leaves this section it will then rapidly spiral down to the wheel and to a pocket.

Preferred angles of the ball track to the horizontal are ten to thirty degrees and preferred angles of the outermost section are from one to ten degrees to the horizontal with the angle of the outermost section being smaller than the angle of the rest of the ball track.

A typical angle of the ball track to the horizontal is twenty degrees and a typical angle for the outermost section is five degrees. The width of the outermost section of the ball track is preferably about the diameter of the ball.

Alternatively the slope of the ball track can change from a greater angle to the horizontal adjacent to the wheel to a smaller angle at the outer rim e.g. by the ball track having a curved profile rather than a straight one. The rate of change in angle can be uniform or non uniform. Typically the angle to the horizontal can change from twenty degrees adjacent to the wheel to five degrees adjacent to the rim.

There can be a fixed outer rim peripherally outward and at the top of the ball track which can incorporate a ball reader so that the position of the ball in a pocket is automatically noted and recorded. A suitable reader is described in Patent Application WO 01/32278.

The wheel can be controlled by a computer so that the output of the sensor or sensors which detect the location of the ball, the stopping of the motor, speed and direction of rotation of the rotor, the timing of the means for ejecting the ball from the pocket, the operation and duration of the means to propel the ball along the ball track, solenoid controlled valves which operate to control the flow of air through the air jets and the air injection means are computer controlled. Alternatively one or more of these functions can be controlled by a croupier, for example the starting of the rotor or the stopping of the rotor can be manually controlled to ensure that all bets are in position.

The apparatus can be used in a range of configurations, including for example a completely automatic one for use in betting terminals which operate without any human intervention; a semi automatic one for live gaming tables in which an operator controls operations such as starting the wheel, deciding when no more bets should be placed and starting the stopping procedure, i.e. turning off the air jets and one for live gaming tables with betting terminals. These are not mutually exclusive e.g. a configuration can be used as a live table and with betting terminals simultaneously.

Another way of preventing the use of optical scanners to predict the result is by polarising the transparent cover.

In addition to the air jet ejecting the ball from the pocket the rotor can be spun at sufficient speed so that the ball is ejected from the wheel by centrifugal force so that it is thrown out of the pocket.

It is a feature of the present invention that there is no need to affect the structure or operation of the roulette wheel by means of trap doors beneath the pockets or moveable rims in order to recover the ball so that it is easier to maintain the randomness of the wheel and the ball is in sight of the players at all times. The invention is also virtually silent in use.

The invention is useful in conjunction with automatic roulette wheels in which bets are placed via slots or other similar mechanism using coins, notes or tokens and the roulette wheel is spun automatically using the present invention. A payout mechanism can be provided to calculate the winnings and to pay them out in coins, tokens etc. The payout mechanism can include a microprocessor to calculate the amount of winnings on different types of bets, thus enabling completely automatic gaming to take place.

The use of computer controls can enable a plurality of roulette wheels to be accurately coordinated, for example two or more roulette wheels can be synchronised so that they start a turn at exactly the same time and finish a turn at the same time and this will enable bets to be placed on two numbers coming up together on different wheels. This enables multiple odds to be paid, for example if the odds on each wheel of a specific number coming up is 37:1 and the payout is 36:1 then the odds on two specific numbers coming up on two wheels are (37×37):1 and the payout is (36×36):1 and so on for three, four wheels etc. This enables very large payouts to be made, for example, a million to one, whilst normal bets can simultaneously be made on the individual wheels.

The invention is described in the accompanying drawing in which.

Figure 1:
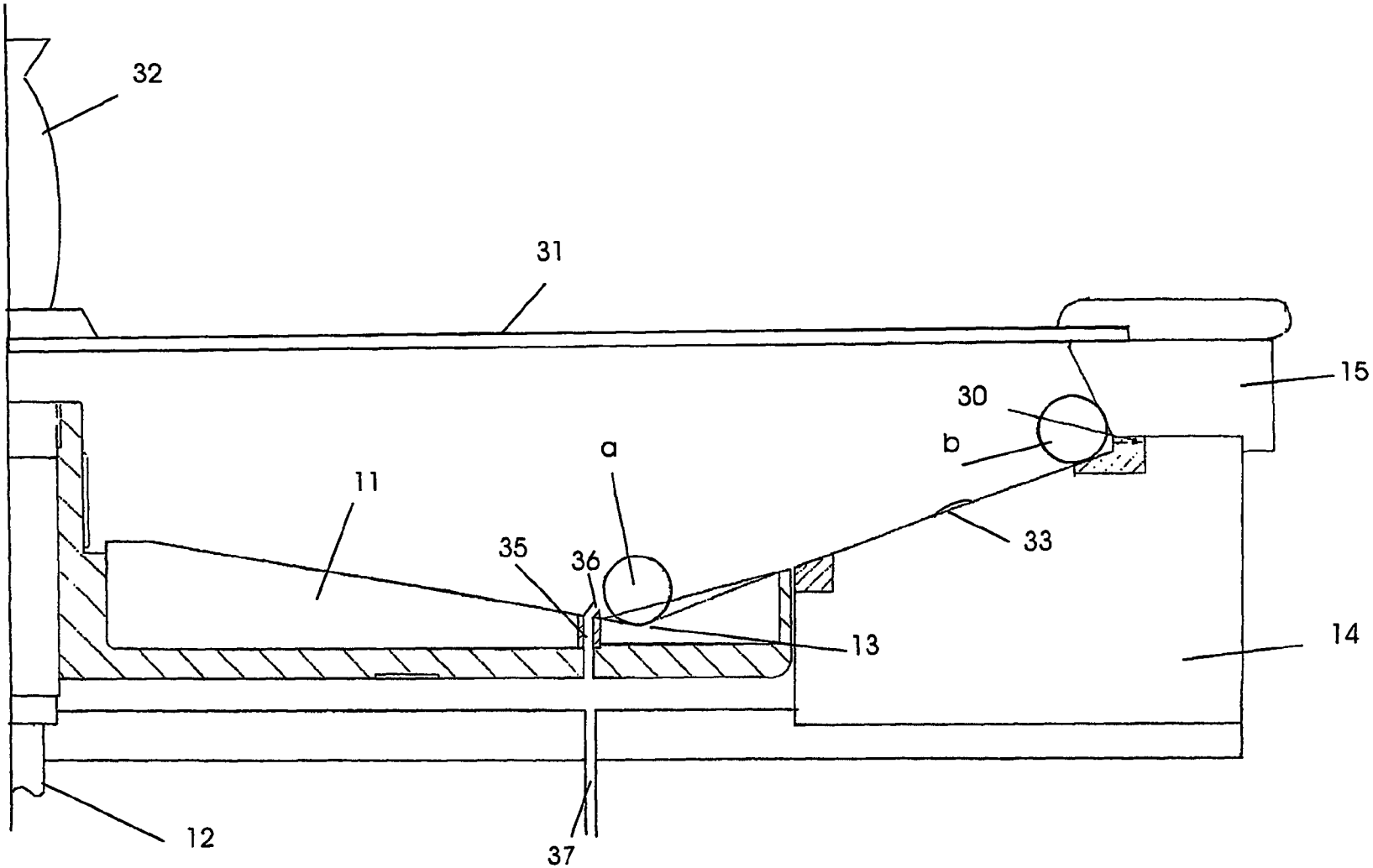
FIG. 1 shows a side view of part of a roulette wheel incorporating an embodiment of the invention.

Referring to FIG. 1 a roulette wheel has a rotor (11) mounted on an axle (12). There are pockets (13) on the periphery of the rotor and each pocket is numbered and coloured. Surrounding the rotor (11) is ball track (14). There is a fixed top rim (15) around the ball track (14) in which there is a number recording device which detects which pocket a ball is in and enables this number to be displayed and recorded. There is a nozzle (35) which can be aligned with air feed (37). There are air jets (30) in the top rim (15) and transparent rigid plastics cover (31) over the wheel. The axle (12) stops beneath the cover (31) and there is a reflective turret (32) mounted over (12). The rotation of the rotor (11) is controlled by motor and the sequence of events controlled by computer. There are ball stops (33) which divide the wheel into sections. The location of the pocket containing the ball is detected by a ball detector as described below and the timing of the air jets and alignment of the air feed (37) and nozzle (35) are controlled by the computer.

Figure 2:
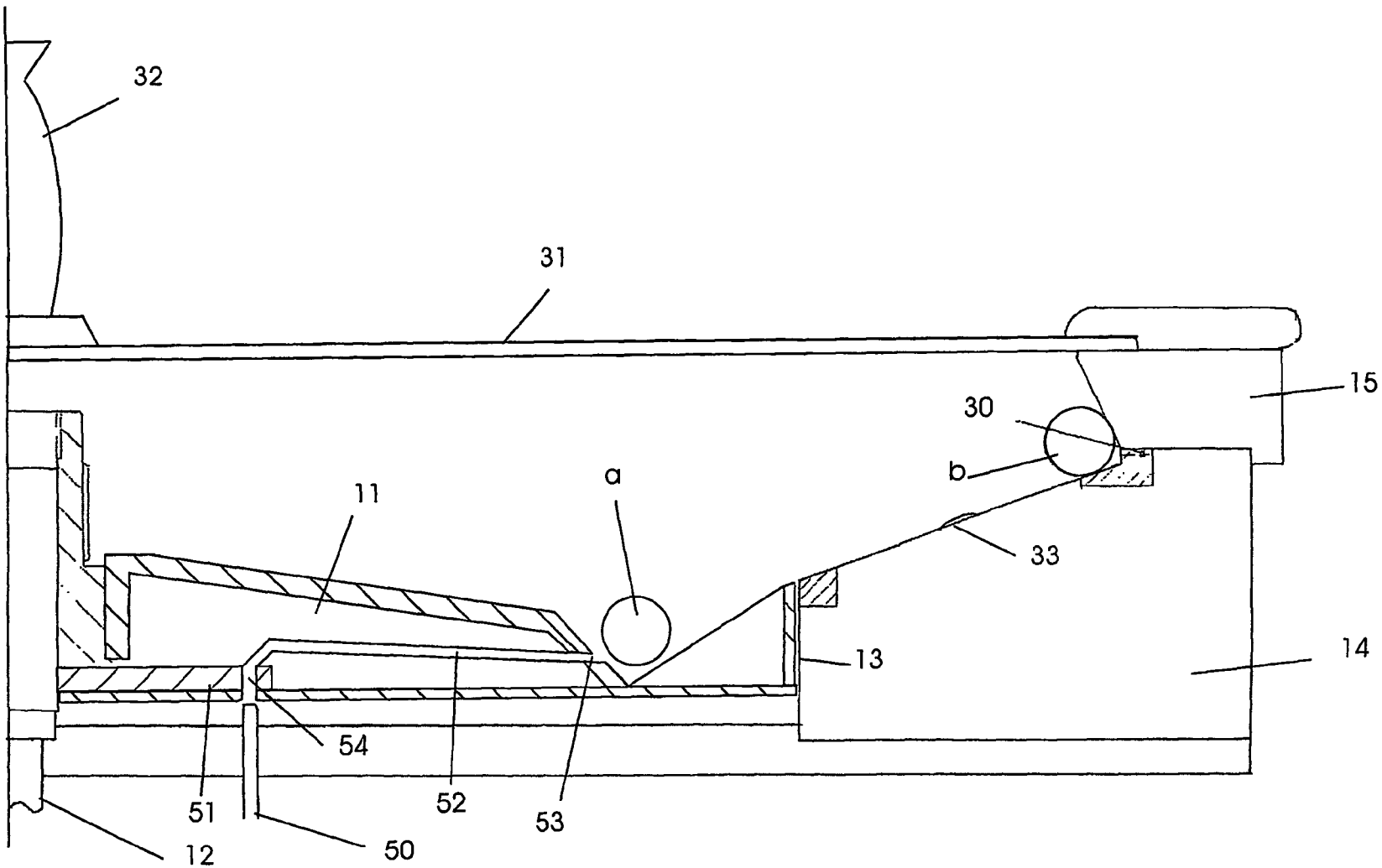
FIG. 2 shows a side view of a second embodiment of the invention.

Referring to FIG. 2 this shows an alternative arrangement in which there is a plate (51) attached to the axle (12) so that it rotates with the rotor (11). The plate (51) has apertures (54) formed in it which are aligned with air nozzle (50). There are tubes (52) connected to the plate above each aperture which connect the aperture (54) in plate (52) to hole (53) in the pocket where the ball is resting. In use, the rotor (11), tubes (52) and plate (51) all rotate as one unit and, when a ball comes to rest in a pocket a sensor senses which pocket has the ball in it and stops the rotor so the pocket containing the ball is aligned with air jets (30) and the plate is aligned so the aperture connected to the pocket which contains the ball is accurately positioned directly above the air nozzle (50). Air is then blown through the aperture (54), down the tube (52) to hole (53) where the ball is then ejected as in FIG. 1. The gap between the nozzle (50) and plate (51) is accurately adjusted to ensure that there is the right air pressure to eject the ball from the pocket.

Figure 3:
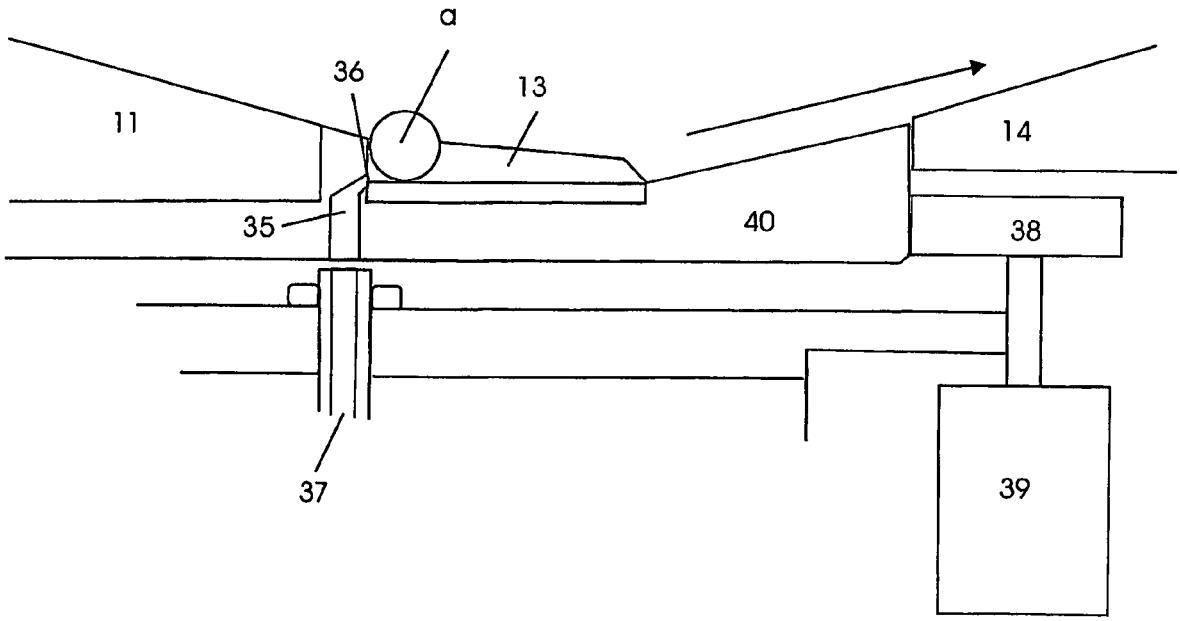
FIG. 3 shows an enlarged view of part of FIG. 1.

Referring to FIG. 3 which shows one pocket in wheel (40) all the pockets have the same configuration. An air line (37) is connected to a source of air above atmospheric pressure, and the pocket (13) has a hole (36) in it connected to a tube (35). The tube (35) is aligned with the air line (37) so that it can be stopped so a pulse of air from air line (37) through tube (35) can be directed through hole (36) to eject ball from pocket (13) onto ball track (14). There is a stepper motor (39) connected through friction wheel (38) to drive and control the rotation of (40). Alternatively a belt drive can be used.

Figure 4:
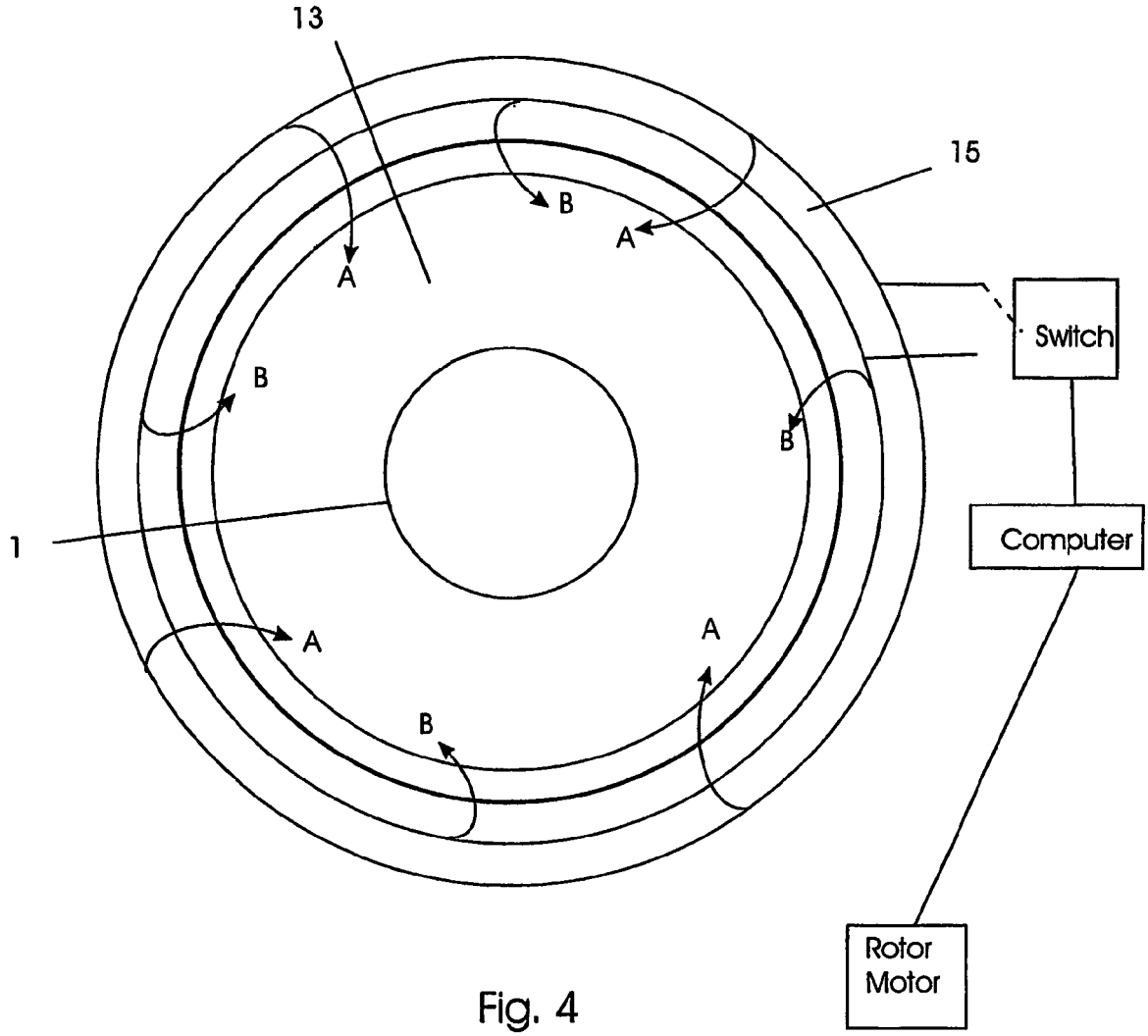
FIGS. 4 and 5 show a plan view showing air jets.

Referring to FIG. 4 there are air jets positioned on the rim (15) with one set of air jets 'A' directed in one direction and one set of air jets 'B' directed in the opposite direction. The air jets are controlled automatically by a computer and a possible control system is shown schematically with the air jets operated by solenoid valves controlled by a computer so the system is automatic and each spin of the rotor can be in the opposite direction to the preceding spin the same direction or in a random direction.

Figure 5:
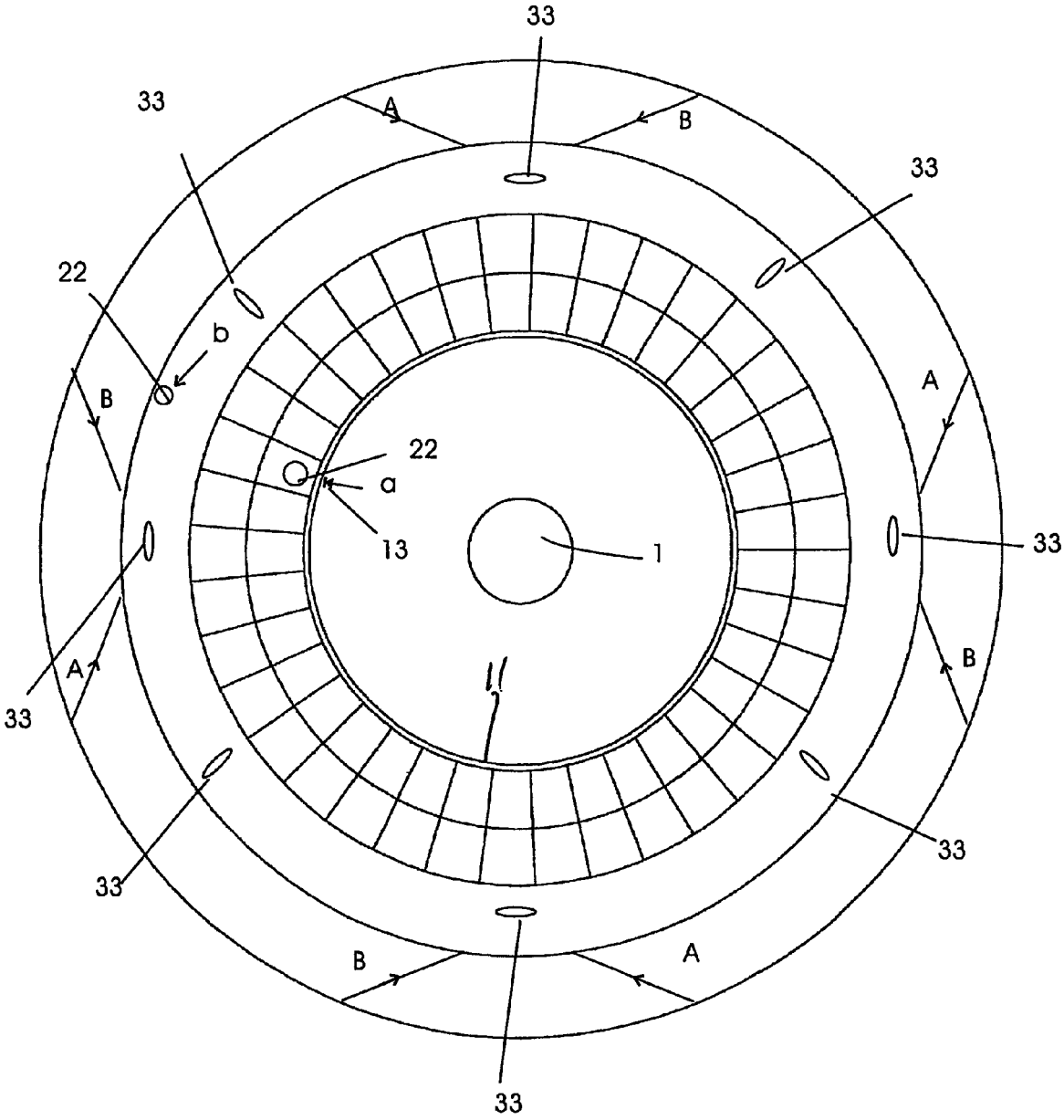

In FIG. 5 there are ball stops (33). At the start the ball (22) is in position 'a' in a pocket (13), a pulse of air is pumped through air line (37) tube (35) and hole (36) and the ball is ejected from the pocket by the air and moves outward until it is in position 'b'. The air jets then propel the ball in direction 'A'. After the ball leaves the pocket (13) the rotor is spun in the reverse direction from the direction the ball is moving. The air jets impart a force to the ball which causes the ball to continue to move around the ball track on or near the rim.

Bets can now be made, if not made before the air jets are turned off and the ball releases from the position shown and spirals down the slope until it lands in a pocket (13) in counter rotating rotor (11). The pocket containing the ball is noted by the ball detection means as the rotor rotates and the bets are settled. This process can then be repeated.

On the next spin the air jets 'B' are operated to cause the ball to circulate on the ball track in the opposite direction.

Figure 6:
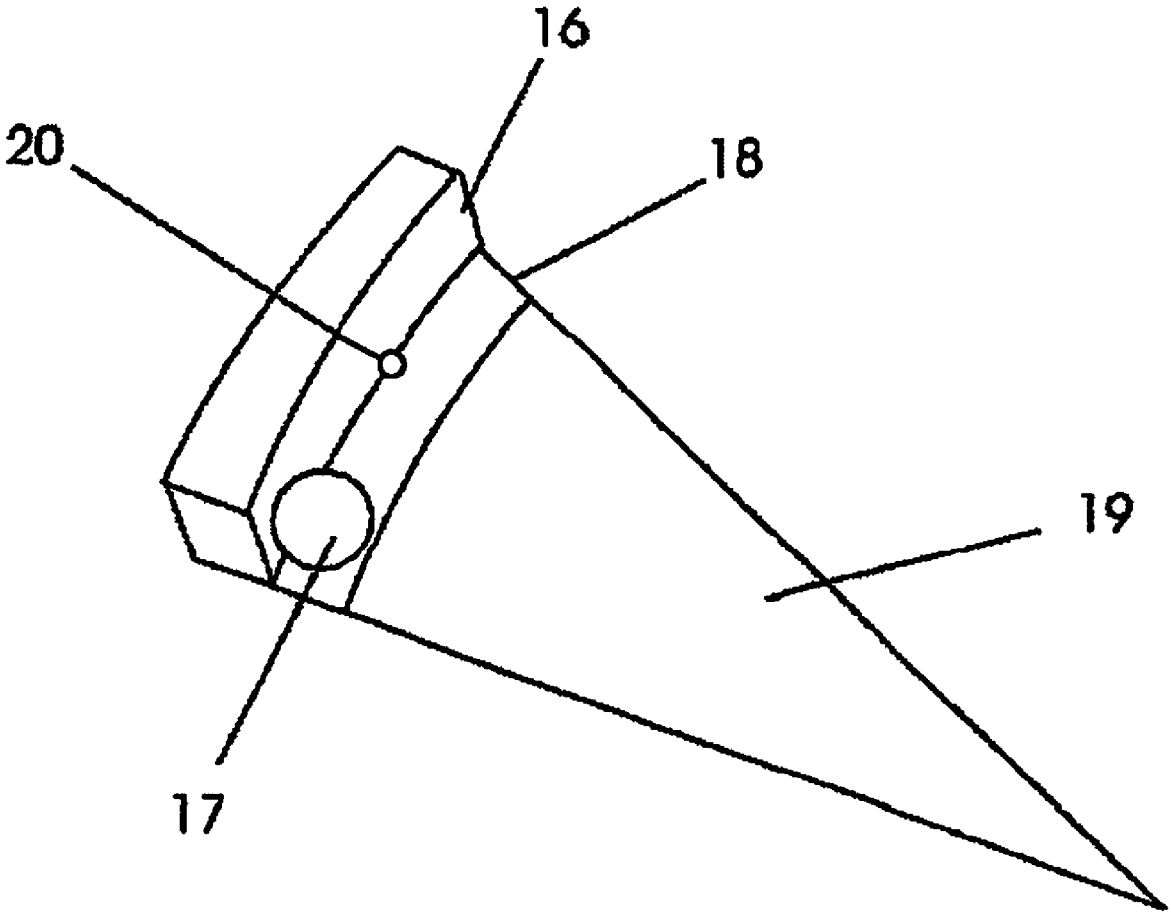
FIG. 6 shows a schematic view of a section of the ball track.

Referring to FIG. 6, there is an outermost section (18) of ball track (19) with a rim (16), and edge (18) and rim (16) are made of plastic strips. There is an air inlet (20) through which compressed air can be jetted out.

In use the ball (17) is ejected from the pocket as described above and moves to the outer edge (18) of ball track (19) and rests against rim (16). The air jet is operated to maintain the ball against rim (16) by centrifugal force. When the air jet is turned off the ball spirals down to a pocket as described above.

Figure 7:
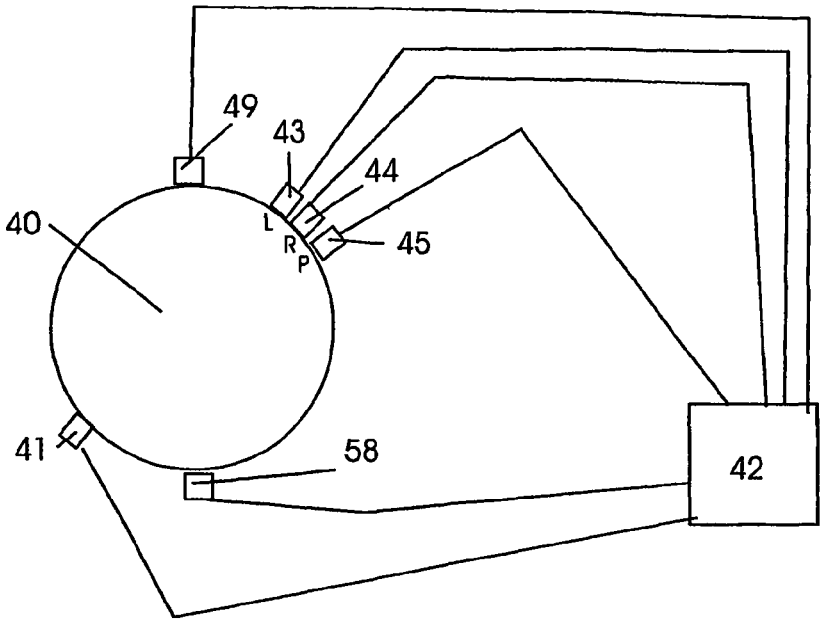
FIGS. 7 and 8 show a diagram of the control circuit.
Figure 8:
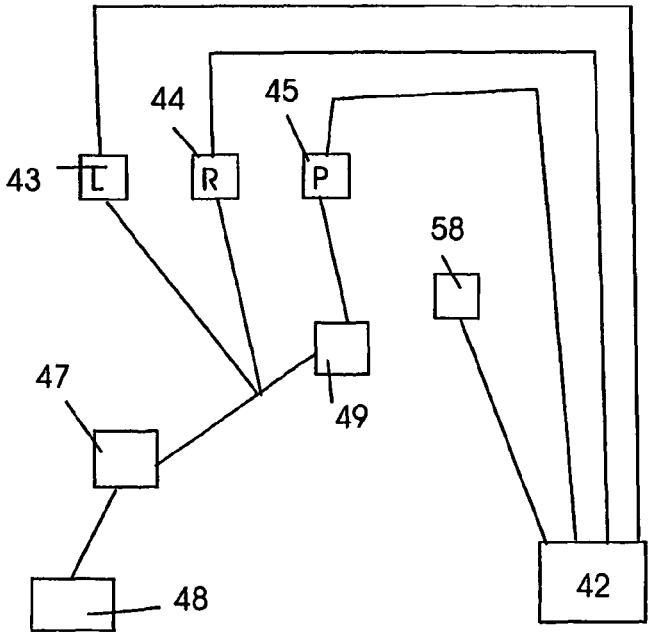

Referring to FIGS. 7 and 8 the operating system comprises the wheel (40), motor (41) encoder (49), ball sensor(s) (58), left rim air injector (43), right rim air injector (44) and air injector (45) for ejecting the ball from the pocket and these are controlled by programmable controller (42). There is a compressor (48) feeding through filter (47) and regulator (49) controlling the operations of the injectors (43), (44) and (45).

A sequence for one embodiment of the invention is:

1. The ball is sitting in a pocket in the rotating rotor as the previous game has closed. The location of the ball has been detected by sensor (58). The rotor is stopped with the pocket with the ball in it aligned so the hole in the pocket is in line with the ejector nozzle (50) FIG. 2. Payouts from the previous game can be made and bets placed as soon as the ball has come to rest in a pocket and before the rotor has stopped.

2. The rotor comes to a rest and a jet of air from air injector (45) (FIG. 8) ejects the ball out of the pocket and up the ball track, the ball then moves to the outside of the ball track.

3. One set of air jets (43) or (44) are turned on and the ball circulates along the rim of the ball track.

4. As soon as the ball has left the rotor, the rotor is made to turn in the opposite direction by the motor (41) at a speed at which a casino croupier would generally keep the wheel turning.

5. After the "no more bets" signal is given no more bets are accepted; the air jets can be turned off before the "no more bets signal", there can be one strong random puff of air after "no more bets signal" or there can be one or more random jets of air after the "no more bets signal" to keep the ball spinning around the ball track. When the jets are turned off the ball will carry on and then spin as if it had been fired by the dealer (the timing of the "no more bets" signal can be controlled by an operator or automatically, and the ball can be kept rotating by the air jets on the rim for a controlled period after the signal has been given); after the jets are turned off the ball spirals down in the same way as when fired by a croupier and comes to rest in a pocket. The location of the ball in the pocket is detected by the sensor (58) and the rotor stopped so that the pocket with the ball in it is stopped with the hole in the pocket aligned with the nozzle or outlet of the conduit. Payouts etc. can then be made as soon as the ball comes to rest in a pocket.

6. The sequence is then restarted and the ball ejected from the pocket by an air jet. The direction of the ball around the rim can be same as the previous turn or in the opposite direction or in a random direction.

The invention recreates what a croupier does, except that no dealer has had a hand in the procedure. In particular, in play, the ball spins one way and the ball the other way and the ball comes to rest in a pocket as in manually operated games.

The invention claimed is:

1. A gaming apparatus which comprises (i) a stationary base; (ii) a wheel having a rotor rotatably mounted on a vertical axis with respect to the base, the rotor having pockets on its periphery into which a ball can be received with each pocket being associated with a number; (iii) a peripheral inclined surface concentric with the rotor for receiving a ball rollably thereon wherein the ball will roll into one of the pockets when the ball slows, the said surface comprising a circular, inclined ball track, disposed above, and radially outwardly of the rotor and (iv) a means to propel the ball along the ball track, each pocket having a hole in it and there being at least one air injection means which is connectable to the said hole so that a ball received in a pocket can be ejected from the pocket onto the peripheral inclined surface by air coming out of the hole.

2. A gaming apparatus according to claim 1 wherein the air injection means comprises a nozzle connected to an air pump, compressor or a source of air at above atmospheric pressure.

3. A gaming apparatus according to claim 2 wherein there are means to stop the rotor so that a hole in the pocket is aligned with the nozzle.

4. A gaming apparatus according to claim 1 wherein there is a conduit leading from the air injection means to a hole in the pocket when the rotor is stopped.

5. A gaming apparatus according to claim 1 wherein there is (i) a plate mounted below the rotor which is rotatable with the rotor, which plate has a plurality of apertures through it with each aperture corresponding to a pocket and the air injection means is mounted below the plate and is located so it is sequentially aligned with each aperture as the plate rotates and (ii) conduits fixed to the upper surface of the plate, each conduit having one end connected to an aperture in the plate and the other end connected to the hole in a pocket so it provides an air passage from the plate to the pocket so that, when an aperture in the plate is aligned with the air injection means, air can be blown through the aperture in the plate, down the conduit to the pocket and so eject a ball from the pocket.

6. An apparatus according to claim 1 wherein there is at least one ball detector means which can detect which pocket contains a ball.

7. An apparatus according to claim 1 wherein there are means for propelling the ball along the ball track by giving an impulse to the ball as it is positioned on the ball track.

8. An apparatus according to claim 7 wherein the means to give an impulse to the ball comprises at least one air jet positioned at the outer edge of the ball track which can direct a jet of air at the ball thus impelling the ball along the ball track.

9. An apparatus according to claim 8 wherein there is at least one air jet directed to propel a ball in one direction around the ball track and at least one air jet directed to propel the ball in the opposite direction.

10. An apparatus according to claim 8 wherein there is a rim fixed to the outer edge of the ball track and, in use, when the ball reaches the outside edge of the ball track it is held against the rim by the action of centrifugal force and there are control means which operate the air jets to give an impulse or impulses of compressed gas to the ball in a single random blast of air or single puffs of air, and, after a predetermined time, the air jets can be turned off so the ball then spirals down the ball track to the contra rotating wheel.

11. An apparatus according to claim 8 wherein there is a computer control means wherein the output from the ball detector means is fed to the computer control means and one or more of the motors or valves controlling the rotation of the rotor, the air injection means, the direction and rotational speed of the rotor, the means to propel the ball along the ball track, the random firing of the ball and control of its speed, the duration and random control of each spin and position of stopping of the rotor is controlled by the computer control means.

12. An apparatus according to claim 8 wherein there are a plurality of ball stops uniformly located around the peripheral inclined surface.

13. An apparatus according to claim 8 wherein there are solenoid controlled valves which operate to control the flow of air through the air jets and the air injection means.

14. An apparatus according to claim 1 which is automatic and there are means whereby bets can be placed via slots or other similar mechanism using coins, notes or tokens and the wheel is spun automatically and there is a payout mechanism which can calculate the winnings.

15. A gaming system which comprises a plurality of gaming apparatus according to claim 1 and means to coordinate the operation of each of the gaming apparatus so that they can operate in a substantially synchronised manner.

16. A method for launching a ball from a pocket in a gaming apparatus which comprises (i) a stationary base; (ii) a wheel having a rotor rotatably mounted on a vertical axis with respect to the base, the rotor having pockets on its periphery into which a ball can be received with each pocket being associated with a number; (iii) a peripheral inclined surface concentric with the rotor for receiving a ball rollably thereon wherein the ball will roll into one of the pockets when the ball slows, the said surface comprising a circular, inclined ball track, disposed above, and radially outwardly of the rotor, the method comprising directing an air jet at the ball from any hole in said each pocket to eject the ball from the pocket, wherein each pocket has a hole and air injection means.

17. A method according to claim 16 wherein the air injection means comprises a nozzle connected to an air pump, compressor or a source of air at above atmospheric pressure and the rotor is stopped so that a hole in the pocket is aligned with the nozzle.

18. A method according to claim 16 wherein there is a fixed rim positioned peripherally outward and at the top of the ball track and the ball is ejected from the pocket up to the rim.

19. A method according to claim 16 wherein the ball is given an impulse to propel the ball along the ball track by at least one air jet positioned at the outer edge of the ball track which directs a jet of air at the ball thus impelling the ball along the ball track.

20. A method according to claim 19 wherein there is a rim fixed to the outer edge of the ball track and when the ball is ejected from a pocket and reaches the outside edge of the ball track it is held against the rim by the action of centrifugal force and the air jets are operated by a control means to give an impulse or impulses of compressed gas to the ball in single random blast of air or single puffs of air, and, after a predetermined time, the air jets are turned off so the ball then spirals down the ball track to the contra rotating wheel.

21. A method according to claim 16 wherein the pocket containing the ball is detected by a ball detector means and the rotor is stopped so that the pocket containing the ball is in the correct position in relation to the means to propel the ball along the ball track.

22. A method according to claim 19 wherein there is a computer control means and the output from the ball detector means is fed to the computer control means and one or more of the motors controlling the rotation of the rotor, the air injection means, the direction and rotational speed of the rotor, the means to propel the ball along the ball track, the random firing of the ball and control of its speed and the duration and random control of each spin and position of stopping of the rotor is controlled by the computer control means.

23. A method for operating a gaming machine according to claim 19 wherein one or more means of the stopping of the motor, speed and direction of rotation of the rotor, the timing of the means for ejecting the ball from the pocket, the operation and duration of the means to propel the ball along the ball track are controlled by an operator.

24. A method according to claim 19 which is completely automatic, semi automatic or an operator controls operations such as starting the wheel, deciding when no more bets should be placed and starting the stopping procedure.

25. An apparatus according to claim 1 which is a roulette wheel.

* * * * *